US006325305B1

(12) United States Patent
Kuhlman et al.

(10) Patent No.: US 6,325,305 B1
(45) Date of Patent: Dec. 4, 2001

(54) FLUID JETTING APPARATUS

(75) Inventors: Larry George Kuhlman, Columbus; Jerry W. Noles, Jr., Spring; Leslie Dale Skinner, Houston, all of TX (US)

(73) Assignee: Advanced Coiled Tubing, Inc., Houston, TX (US)

( * ) Notice: Subject to any disclaimer, the term of this patent is extended or adjusted under 35 U.S.C. 154(b) by 0 days.

(21) Appl. No.: 09/488,071

(22) Filed: Jan. 19, 2000

Related U.S. Application Data

(62) Division of application No. 09/020,100, filed on Feb. 6, 1998.

(60) Provisional application No. 60/037,321, filed on Feb. 7, 1997.

(51) Int. Cl.[7] ..... A62C 2/08

(52) U.S. Cl. ..... 239/548; 239/556; 239/558; 166/222; 166/312

(58) Field of Search ..... 239/548, 600, 239/DIG. 13, 556, 558, 559; 166/222, 223, 312, 51; 175/424; 294/86.17, 86.34, 86.22; 134/167 C, 166 C, 22.12

(56) References Cited

U.S. PATENT DOCUMENTS

| | | | | |
|---|---|---|---|---|
| Re. 31,495 | * | 1/1984 | Zublin | 166/312 |
| 2,167,194 | * | 7/1939 | Anderson | 166/223 |
| 2,327,051 | * | 8/1943 | Lyons et al. | 166/222 |
| 3,116,793 | | 1/1964 | McStravick | 166/21 |
| 3,262,508 | * | 7/1966 | Price | 175/424 |
| 3,583,489 | | 6/1971 | Hutchison et al. | 166/312 |
| 4,030,548 | | 6/1977 | Richardson et al. | 166/279 |
| 4,349,073 | | 9/1982 | Zublin | 166/312 |
| 4,442,899 | | 4/1984 | Zublin | 166/312 |
| 4,518,041 | | 5/1985 | Zublin | 166/312 |
| 4,677,997 | * | 7/1987 | Strauss | 239/DIG. 13 |
| 4,781,250 | | 11/1988 | McCormick et al. | 166/240 |
| 4,977,958 | * | 12/1990 | Miller | 166/51 |
| 5,060,725 | | 10/1991 | Buell | 166/222 |
| 5,183,112 | | 2/1993 | Paul et al. | 166/312 |
| 5,375,378 | * | 12/1994 | Rooney | 134/22.12 |
| 5,456,552 | * | 10/1995 | Cherrington | 175/424 |
| 5,469,926 | * | 11/1995 | Lessard | 175/424 |
| 5,533,571 | * | 7/1996 | Surjaatmadja et al. | 166/222 |
| 5,839,511 | * | 11/1998 | Williams | 166/223 |
| 6,029,746 | * | 2/2000 | Dodd | 166/222 |
| 6,170,577 | * | 1/2001 | Noles et al. | 166/312 |

OTHER PUBLICATIONS

Excerpts from Advanced Drilling Techniques, Section 5, "Abrasive Jet Drills", pp. 19–27 (other information unknown).

Ford, W.G.F., Gadeken, L.L., Callahan, T.J., Jackson D., "Solvent removes downhole NORM–contaminated BaSO4 scale", Oil and Gas Journal, Apr. 22, 1996, p. 65–68.

Paul, J.M., "An Improved Solvent for Sulfate Scales", 46$^{th}$ Annual NACE International Corrosion Conference, Baltimore, Md., Paper No. 57, 1994, pp. 1–14.

Abstracts of various publications from Petroleum Abstracts Database from search conducted in Apr. 1996, 21 abstracts, 7 pages.

* cited by examiner

*Primary Examiner*—David A. Scherbel
*Assistant Examiner*—Dinh Q. Nguyen
(74) *Attorney, Agent, or Firm*—E. Randal Smith

(57) ABSTRACT

A fluid jetting nozzle includes a nozzle head and at least one jetting orifice in the nozzle head, the jetting orifice(s) being capable of ejecting a mixture that includes substantially spherically shaped solid particles and fluid to loosen obstructive material from a metallic surface.

56 Claims, 6 Drawing Sheets

FIG. 6
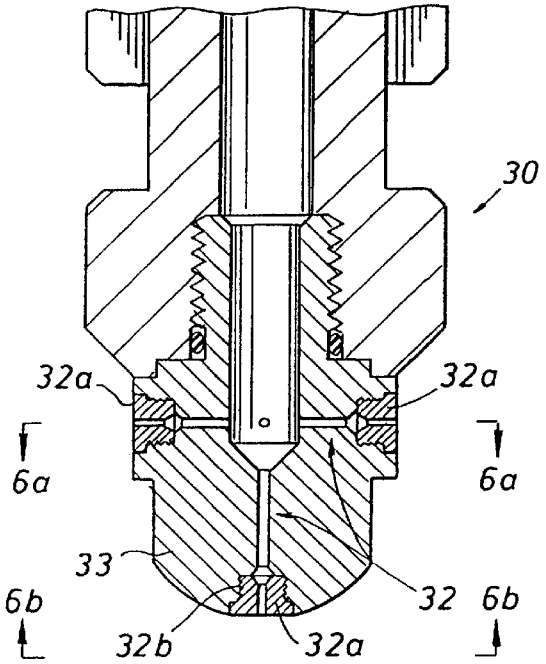
FIG. 5
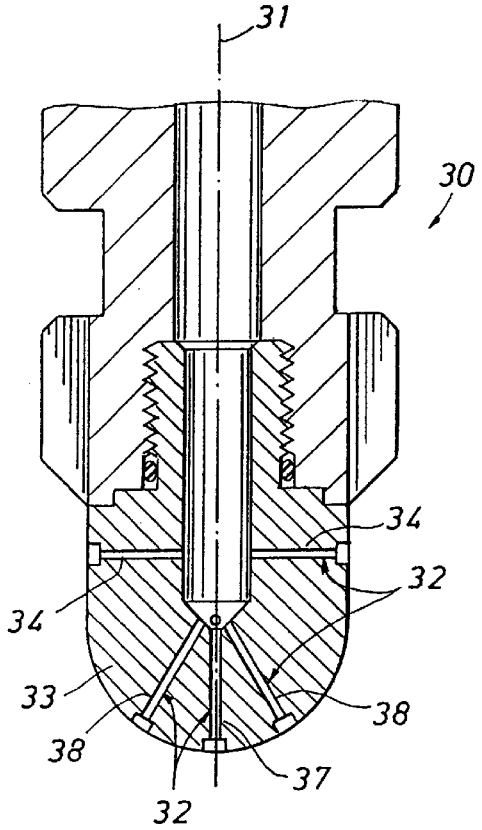
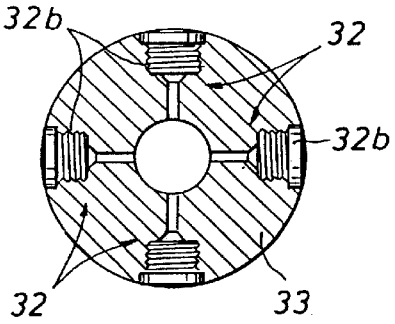
FIG. 6a
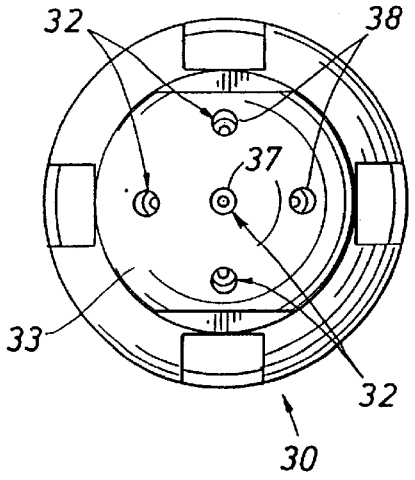
FIG. 5a
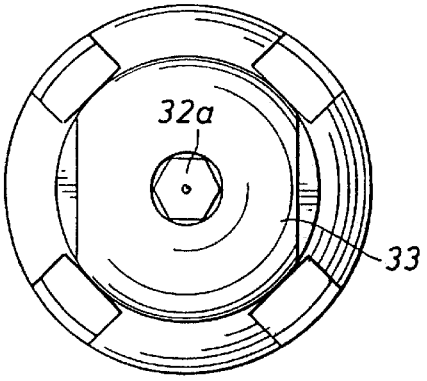
FIG. 6b FIG. 8
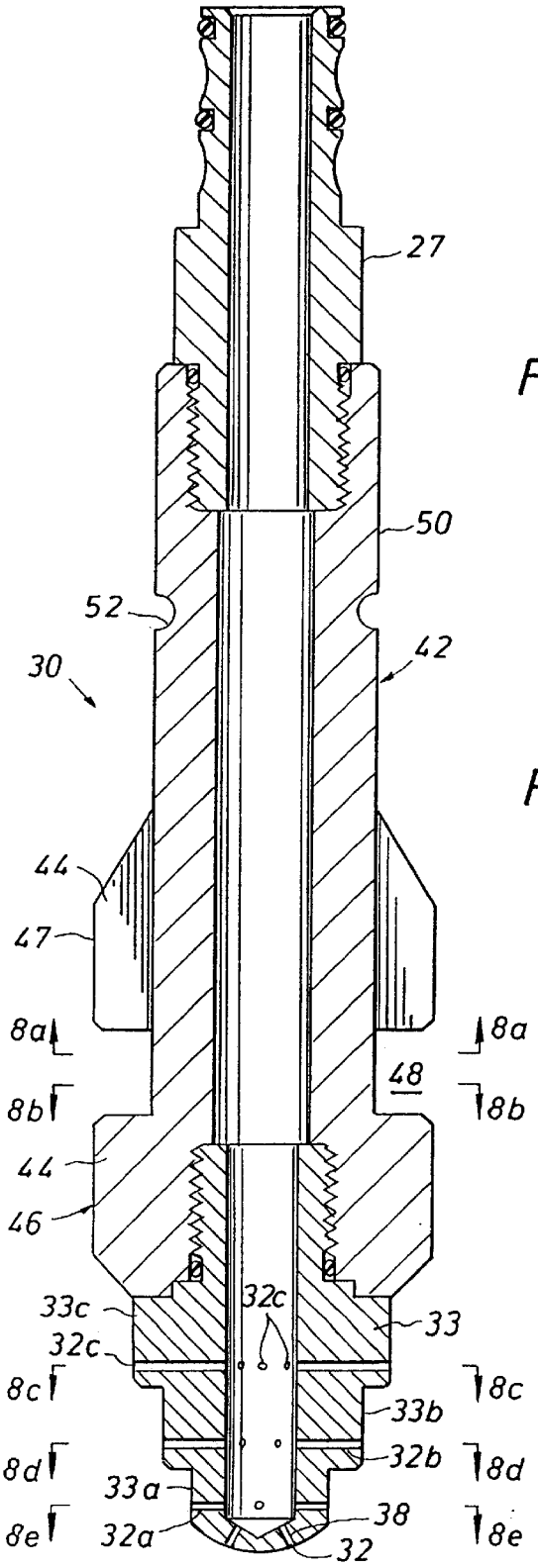
FIG. 8a
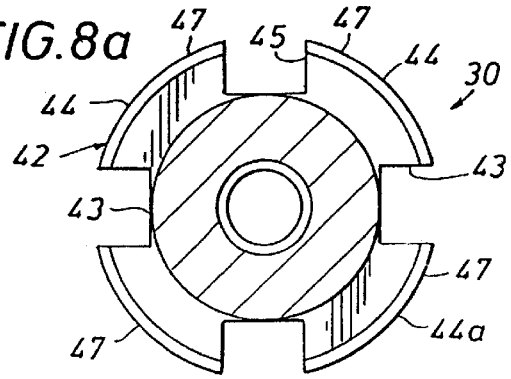
FIG. 8b
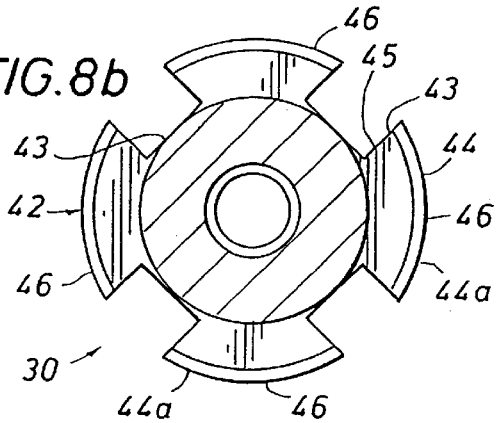
FIG. 8c
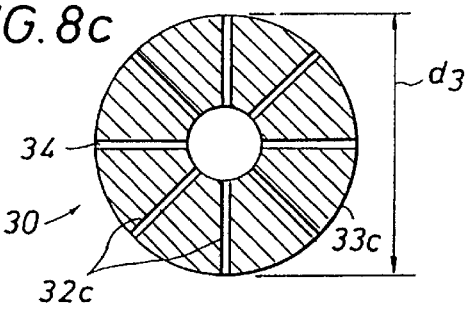
FIG. 8d
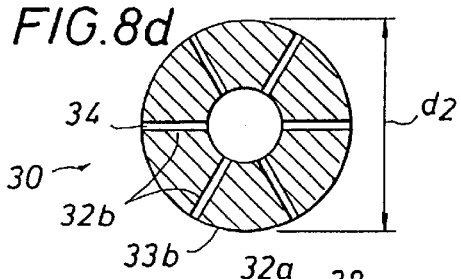
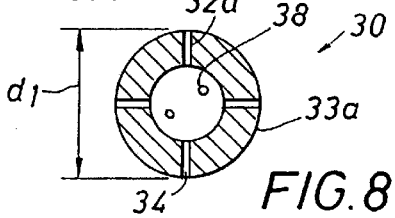
FIG. 8e FIG. 11
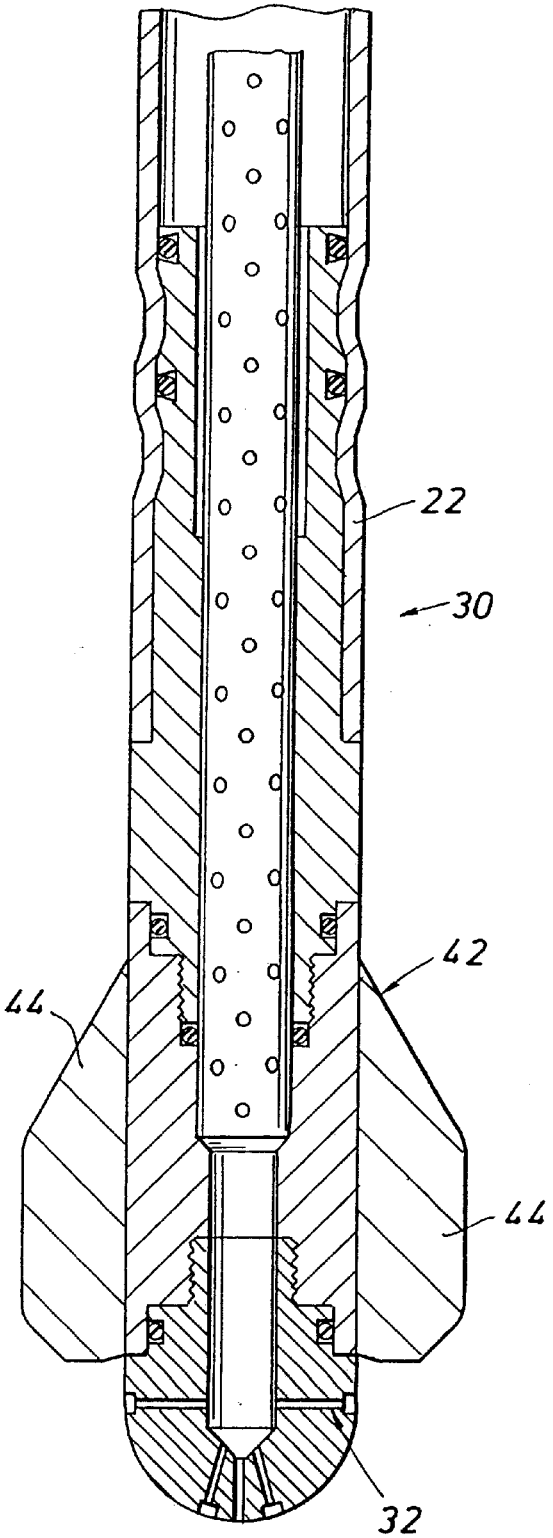
FIG. 9
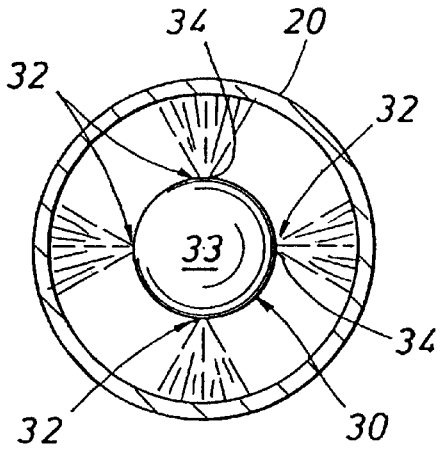
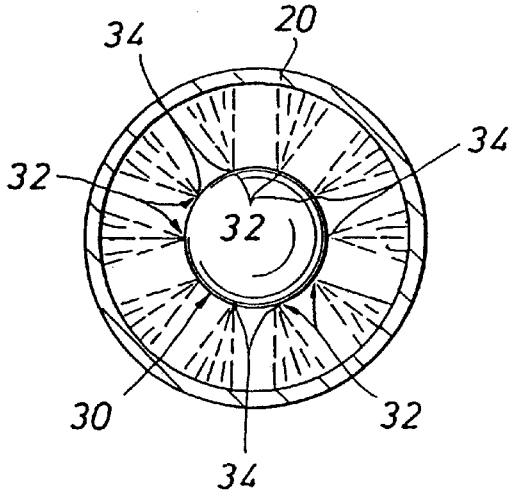
FIG. 10

FLUID JETTING APPARATUS

CROSS REFERENCE TO RELATED APPLICATIONS

This application is a divisional of application Ser. No. 09/020,100, filed on Feb. 6, 1998. The nonprovisional application designated above, namely application Ser. No. 09/020,100, filed Feb. 6, 1998, claims the benefit of U.S. Provisional Application(s) No. 60/037,321 filed on Feb. 7, 1997.

STATEMENT REGARDING FEDERALLY SPONSORED RESEARCH AND DEVELOPMENT

Not applicable.

BACKGROUND OF THE INVENTION

The invention relates generally to the field of apparatus and methods used for removing material from inside a conduit. More particularly, the present invention relates to a nozzle capable of loosening and removing material built-up on the inside surface of, or disposed within, a metal conduit.

Undesirable materials that build-up on the inside walls of conduits, such as well tubing, injection lines, pipelines, flowlines, boiler tubes, heat exchangers and water lines, or that otherwise collect inside the conduits, are known to restrict or interfere with the desired movement of fluids, materials and devices, tools, liquids and gases through the conduits. As a result, in many cases, the conduit becomes useless, or inoperable for its intended purpose. For example, thousands of petroleum wells in this country have been shut down or abandoned due to the crippling effect on operations of obstructions in the well tubing. Examples of such undesirable, or obstructive, materials include barium sulfate, strontium sulfate, calcium sulfate, calcium carbonate, iron sulfide, other scale precipitates (such as silicates, sulfates, sulfides, fluorides, carbonates), cement, corrosion products, deteriorated conduit lining, and dehydrated material (such as drilling fluid).

Existing methods of removing obstructive materials from conduits have numerous disadvantages. Various techniques involve the use of a mill or bit to remove obstructive material from conduits. In many applications, the mills or bits have a short useful life due to damage from contact between the mills and bits and commonly occurring hard, dense obstructive materials. The mills or bits must therefore be frequently removed from the conduit and replaced, consuming time and expense. Further, rotation of the mill or bit requires additional component parts, such as a motor, bearings and rotary seals, which are complex and costly to manufacture and operate and subject to failure. Rotary seals typically limit the use or effectiveness of the system due to their vulnerability to wear or damage from high temperatures.

These techniques are also largely ineffective at loosening and removing substantially all obstructive material without damaging the conduit. For example, the inside walls of conduits cleaned with mills or bits are highly subject to damage from contact by the mill or bit. Such contact commonly occurs when the obstructions in the conduit are unevenly dispersed, causing the mill or bit to jam or rub against, or drill into, the side of the conduit. Further, reactive torque due to the rotation of the drill or mill can also cause it to contact the inside surface of the conduit and cause damage thereto. Such reactive torque also accelerates deterioration to the tubing, such as coiled tubing, that carries the mill or bit.

Other conventional cleaning methods utilize jet nozzles that eject only liquid or angular-shaped solid particles in a foam or liquid transport medium. Typical liquid-only systems insertable in a conduit of significant length, such as petroleum tubing and pipelines, operate in low to moderate pressure ranges. These systems have proven ineffective at loosening or removing commonly encountered hard, tightly bonded obstructive materials, such as barium sulfate. The jet systems using angular-shaped solids typically damage the inside surface of metal conduits as a result of the angular solids cutting, scarring and eroding the metal. These systems lack the ability to minimize or control the amount of damage that occurs to the metal conduit; therefore, their use is not entirely satisfactory for many applications. Further, the angular solids provide an erratic erosion pattern, limiting their effectiveness in loosening and removing obstructions.

Thus, there remains a need for a nozzle for loosening and removing undesirable materials built-up on the inside surface of metal conduits, or that otherwise collect inside the conduits, that does not cause substantial or undesirable damage to the conduit. Preferably, the nozzle will be simple, and cost effective and easy to manufacture and operate. Ideally, the nozzle could utilize existing equipment. Especially well received would be a nozzle that can quickly remove all, or substantially all, of the undesirable materials. Ideally, the nozzle would not need to be rotated and would have static seals unaffected by high temperatures.

BRIEF SUMMARY OF THE INVENTION

In accordance with the present invention, there is provided an apparatus for removing obstructive material from inside a conduit. In one embodiment, the apparatus is a nozzle capable of ejecting a mixture including a plurality of substantially spherically shaped solid particles and fluid. The nozzle may include one or more of nozzle jets capable of ejecting the mixture to loosen obstructive material inside the conduit.

In preferred embodiments, the apparatus may be capable of ejecting the mixture to loosen obstructive material inside the conduit without substantially damaging the conduit, and ejecting the mixture around the inner circumference of the conduit without rotating the nozzle assembly.

A filter capable of preventing clogging of the nozzle jets by particles carried in the mixture may be included.

In another aspect of the invention, there is provided a nozzle assembly for ejecting a mixture that includes substantially spherically shaped solid abrasive particles and fluid, the nozzle assembly having a central axis and being associated with a mixture delivery tubing. The nozzle assembly includes a connector member connectable with the mixture delivery tubing, a nozzle head member having a plurality of nozzle jets, at least two of the nozzle jets disposed at angles of between approximately 80 degrees and approximately 100 degrees relative to the central axis of the nozzle assembly, and a gauge ring member disposed between the connector member and the nozzle head member.

In alternate embodiments, the nozzle assembly includes a plurality of nozzle jet inserts matable with a plurality of recesses in the nozzle head member. In alternate embodiments, at least one of the nozzle jets is disposed in the nozzle assembly at an angle of approximately 0 degrees relative to the central axis of the nozzle assembly. At least one of the nozzle jets may be disposed in the nozzle assembly at an angle of between approximately 0 degrees and approximately 90 degrees relative to the central axis of the nozzle assembly, or at least two of the nozzle jets may be disposed in the nozzle assembly at angles of between approximately 10 degrees and approximately 20 degrees relative to the central axis of the nozzle assembly. The nozzle assembly may include a plurality of nozzle assembly sections, each nozzle assembly section having a diameter different than the diameter of adjacent nozzle assembly sections and wherein at least one nozzle jet is disposed in each nozzle assembly section.

The gauge ring may include at least one wide portion and at least one external fluid flow passageway, the wide portion (s) and external fluid flow passageway(s) disposed between the nozzle jets and the mixture delivery tubing. The gauge ring may include a plurality of wide portions, each wide portion having an outer bearing surface, the plurality of outer bearing surfaces extending around the circumference of the nozzle assembly. One or more wide portions may be located proximate to at least two of the nozzle jets. The gauge ring may include first and second sets of wide portions, the second set of wide portions disposed between the first set of wide portions and the plurality of nozzle jets and being at least partially offset on the circumference of the nozzle assembly relative to the first set of wide portions.

The nozzle assembly may be disposed in a conduit and include a fishing tool connection portion, wherein the fishing tool connection portion is capable of being engaged by a fishing tool latch mechanism. Further, the fishing tool connection portion may include a recess capable of receiving a fishing tool latching mechanism. The nozzle assembly may include a filter capable of preventing clogging of the nozzle jets from particles carried in the mixture, and the filter may be disposed at least partially in the mixture delivery tubing.

In another aspect of the invention, there is provided a method of removing obstructive material from inside a conduit including supplying a mixture including fluid and substantially spherically shaped solid abrasive particles through a nozzle having at least one nozzle jet, the nozzle adapted to increase the velocity of the mixture upon ejection therefrom, positioning the nozzle within the conduit proximate to obstructive material in the conduit, and ejecting the mixture through the nozzle against the obstructive material to loosen the obstructive material.

The method of removing obstructions may further include moving the tubing through at least a partial length of the conduit to loosen obstructive material in the at least partial length of the conduit. The method may include removing the delivery tubing from the conduit, replacing the nozzle with a second nozzle of a different type or having a different configuration than the first nozzle to improve efficiency or effectiveness depending upon the particular existing conditions.

The method may include additional elements, such as: ejecting the mixture from the nozzle to loosen the obstructive material inside the conduit without substantially damaging the conduit; ejecting the mixture from the nozzle to loosen material inside the conduit without rotating the delivery tubing and without rotating the nozzle; ejecting the mixture from the nozzle at angles of between about 80 degrees and about 100 degrees relative to the inside surface of the conduit; connecting a gauge ring to the nozzle and moving the delivery tubing through the conduit to detect the location of material within the conduit and center the nozzle assembly within the conduit.

Accordingly, the present invention comprises a combination of features and advantages which enable it to substantially advance the technology associated with removing obstructions from conduits. The present invention includes a nozzle capable of efficiently and effectively loosening and removing obstructions in the conduit. The present invention includes a nozzle capable of loosening and removing the obstructions without causing substantial or undesirable damage to the conduit. The present invention may be simple, cost effective and easy to manufacture and operate. Ideally, the inventive nozzle could utilize existing equipment, may not need to be rotated and can use static seals unaffected by high temperatures. The characteristics and advantages of the present invention described above, as well as additional features and benefits, will be readily apparent to those skilled in the art upon reading the following detailed description and referring to the accompanying drawings.

BRIEF DESCRIPTION OF THE DRAWINGS

For a detailed description of the preferred embodiments of the invention, reference will now be made to the accompanying drawings wherein:

FIG. 5 is a partial cross-sectional view of still another embodiment of a nozzle in accordance with the present invention.

FIG. 5*a* is a front view of the nozzle assembly of FIG. 5 showing the center nozzle jets and angled nozzle jets.

FIG. 6 is a partial cross-sectional view of an embodiment of a nozzle assembly having nozzle jet inserts in accordance with the present invention.

FIG. 6*a* is a cross-sectional view of the device of FIG. 6 taken along lines 6*a*—6*a* showing the side nozzle jet insert recesses in accordance with the present invention.

FIG. 6*b* is a front view of the nozzle assembly of FIG. 6 showing the center nozzle jet insert.

FIG. 8 is a cross sectional view of the nozzle assembly of FIG. 7.

FIG. 8*a* is a cross-sectional view of the device of FIG. 8 taken along lines 8*a*13 8*a* showing the second set of wide portions of the gauge ring and associated external fluid passageways in accordance with the present invention.

FIG. 8*b* is a cross-sectional view of the device of FIG. 8 taken along lines 8*b*—8*b* showing the first set of wide portions of the gauge ring and associated external fluid passageways in accordance with the present invention.

FIG. 8*c* is a cross-sectional view of the device of FIG. 8 taken along lines 8*c*—8*c* showing the side nozzle jets on the third nozzle head step in accordance with the present invention.

FIG. 8*d* is a cross-sectional view of the device of FIG. 8 taken along lines 8*d*—8*d* showing the side nozzle jets on the second nozzle head step in accordance with the present invention.

FIG. 8*e* is a cross-sectional view of the device of FIG. 8 taken along lines 8*e*—8*e* showing the side nozzle jets and angled nozzle jets on the first nozzle head step in accordance with the present invention.

FIG. 9 is an end view of the downstream end of a nozzle assembly made in accordance with the present invention shown in a conduit.

FIG. 10 is an end view of the downstream end of another embodiment of a nozzle assembly made in accordance with the present invention shown in a conduit.

FIG. 11 is a partial cross-sectional view of another embodiment of a nozzle assembly of a conduit cleaning system in accordance with the present invention.

DETAILED DESCRIPTION OF THE PREFERRED EMBODIMENTS

Figure 1:
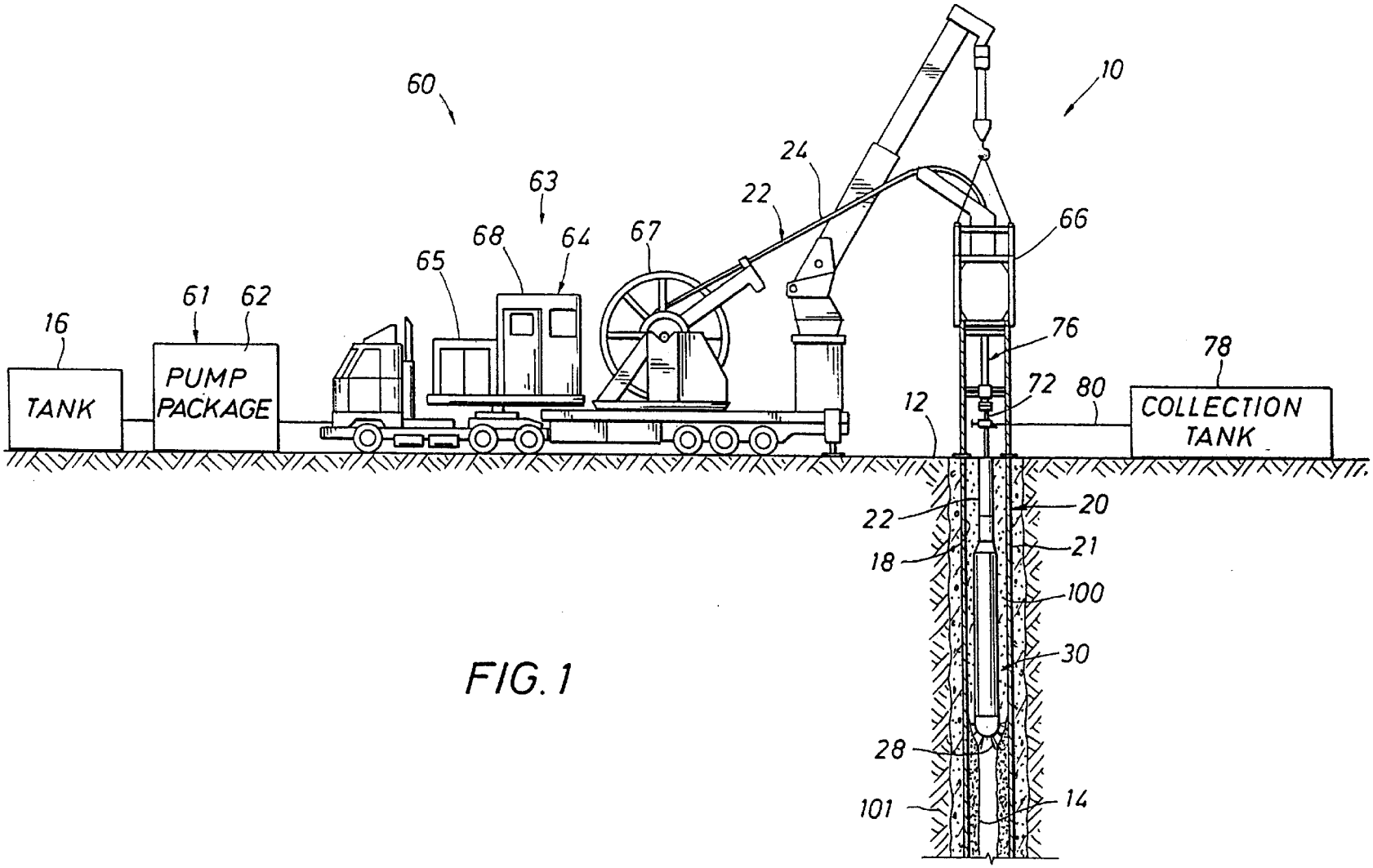
FIG. 1 is a side view of an embodiment of a conduit cleaning system and mixture delivery system shown in use in an underground petroleum well tubular utilizing a nozzle of the present invention.

Presently-preferred embodiments of the invention are shown in the above identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

Figure 2:
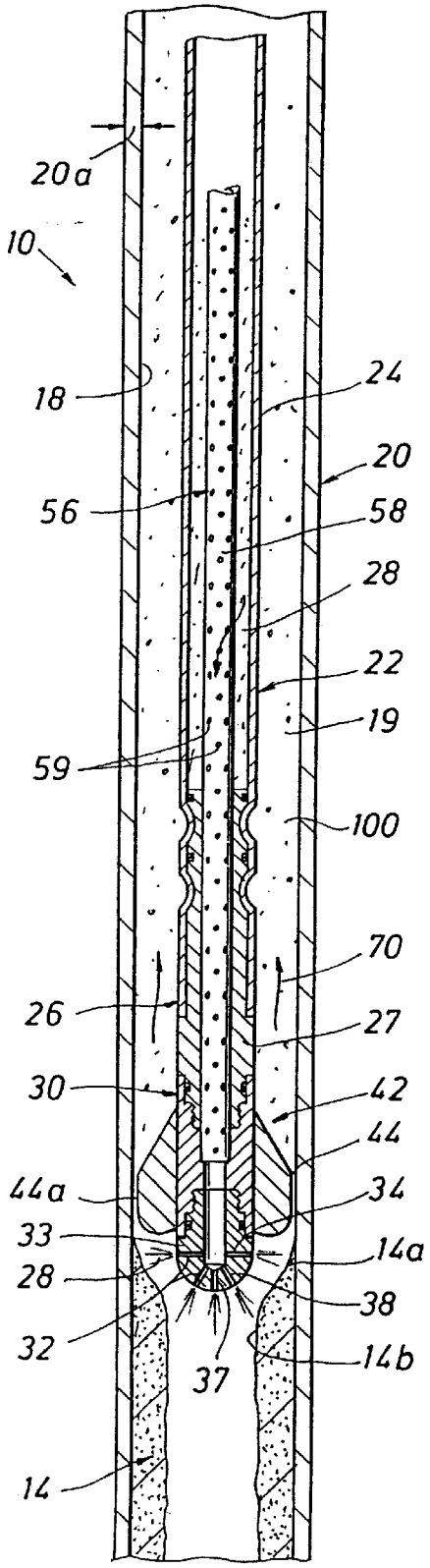
FIG. 2 is a partial cross-sectional view of an embodiment of a nozzle in accordance with the present invention in use in a conduit.

Referring initially to FIGS. 1 and 2, a conduit cleaning system 10 using a nozzle 30 of the present invention capable of loosening and removing obstructive material (obstructions) 14 built-up on the interior surface 18 of, or otherwise disposed in, a metallic conduit 20 is shown. The obstructions 14 can partially, or completely, obstruct the passage of fluids, material or equipment through the conduit 20. Many different types of obstructive material 14 may be removed with the use of the system 10, including, but not limited to, barium sulfate, strontium sulfate, calcium sulfate, calcium carbonate, iron sulfide, other scale precipitates (such as silicates, sulfates, sulfides, fluorides, carbonates), cement, corrosion products, deteriorated conduit lining, and dehydrated material (such as drilling fluid). As used herein and in the appended claims, the terms "obstructions," "obstructive material" and variations thereof mean all types of undesirable materials built-up on the interior surface of, or otherwise disposed in, a metallic conduit.

The metallic conduit 20 illustrated in FIG. 1 is an underground petroleum well tubular 21, but the conduit 20 may be any type of tubular element containing obstructive material 14 or having obstructive material 14 disposed on its interior surface 18, such as well tubing, well casing, injection lines, pipelines, flowlines, boiler tubes, heat exchangers and water lines. Further, it should be understood that the present invention may also be useful in loosening and removing obstructions in components (not shown) associated with or attached to the conduit 20 and having surfaces accessible through the conduit 20, such as, but not limited to, connectors, safety valves, gas lift valves and nipples.

Still referring to FIGS. 1 and 2, the system 10 may include an obstruction removal mixture 28, a mixture carrier tubing 22 and a nozzle assembly 30. An example of tubing 22 is conventional coiled tubing 24, but the tubing 22 can take any other suitable form. Further, the tubing 22 is preferably controllably movable through the conduit 20 and allows delivery of the mixture 28 under pressure to the nozzle assembly 30, which ejects the mixture 28 against the obstructions 14.

The obstruction removal mixture 28 may include particles (not shown) that: (1) have a spherical or substantially spherical shape; (2) are constructed at least partially of solid material (the term "solid" as used herein and in the appended claims means not liquid or gaseous); and (3) are abrasive, the term "abrasive" as used herein and in the appended claims meaning capable of pulverizing, shattering, fracturing or otherwise loosening brittle material. These particles are referred to herein and in the appended claims as "spherical solids," "spherical solid particles," "substantially spherically shaped solid abrasive particles" and variations thereof. Other properties of the spherical solids, such as size, density and composition, can be selected and varied as desired. For example, spherical solids having densities greater or lesser than the density of the fluid or of the obstructive materials may be desirable. Examples of types of spherical solids include, but are not limited to, particles constructed partially or entirely of glass, ceramic, plastic, metal, epoxy or combinations thereof; such as glass beads, hollow glass beads, ceramic beads and metal shot. Spherical solids having various sizes, such as, for example, beads ranging from about 20 mesh to about 100 mesh, may be desirable.

The mixture 28 also includes fluid. As used herein and in the appended claims, the term "fluid" means one or more liquids, one or more gasses, foam or a combination thereof. The mixture 28, having fluid and spherical solid abrasive particles, is useful in the loosening and removal of obstructions 14 built up on the conduit surface 18 or otherwise inside the conduit 20. For example, a mixture 28 having a concentration of between about ⅛ and about ¾ lb of spherical glass beads, such as beads sized at between about 20 mesh and about 100 mesh, per gallon of fluid supplied through the tubing 22 at a flow rate of between about 0.50 bbl/min and about 1.50 bbl/min and ejected in accordance with the present invention may be used to effectively remove various types of obstructions from conduit 20 at rates of between about 1 ft/min and about 8 ft/min. It should be understood that the present invention is not limited to the above example formulation, and any suitable formulation of mixture 28 may be used.

The mixture 28, having spherical solids as described herein, may, if desired, be formulated to allow controlled, or minimal, erosion and damage to the conduit surface 18. For instance, the composite type, mass, particulate size, angle of impact and concentration of the spherical solids can be selected to minimize erosion or damage to the conduit surface 18. Certain composite types of spherical solids have a greater capability of causing generally more or less erosion or damage to the conduit surface 18 under similar operating conditions. Spherical solid metal or steel shot or beads, for example, generally causes greater erosion to a metallic conduit 20 as compared with glass beads under similar operating conditions. Further, the smaller the particulate size of the individual spherical solid beads or shot, generally the less the erosive effect on the conduit surface 18 under similar operating conditions in accordance with the present invention. For example, effective removal of obstructions 14 with a mixture 28 containing small glass beads, such as beads sized at between about 60 mesh and about 100 mesh, may cause a desirably smooth finish on the conduit surface 18, while a mixture 28 with a similar concentration of larger spherical glass beads, such as beads sized at between about 20 mesh and about 40 mesh, may cause minor dimpling and may create a rougher finish on the interior surface 18.

The fluid used in the mixture 28 may be any among a variety of fluids having characteristics capable of generally uniformly carrying the spherical solids through the tubing 22, such as gas, water, other liquids, foam or a combination thereof. Various fluids containing chemicals may be included in the mixture 28, such as acids or solvents designed to dissolve particular types of obstructions. For example, the mixture 28 may be a gelled fluid matrix, such as a mixture of about 1½ quarts of Xanvis® per barrel of seawater.

It should be understood that the present invention is directed to a nozzle, or fluid jetting apparatus (of which nozzle 30 as described above and shown in the appended figures is one or numerous embodiments or example(s) thereof), and not to a system, such as system 10. System 10 is an embodiment, or example, of the invention of U.S. patent app. Ser. No. 09/020,100 entitled Conduit Cleaning System and Method, filed on Feb. 6, 1998, now U.S. Pat. No. 6,170,577, which is incorporated herein by reference in its entirety. System 10 is used herein solely as an exemplary environment with which the present invention may be used. Neither the present invention nor any of the appended claim is limited to use with system 10, or to any of the details, as described above, unless and only to the extent expressly recited in a particular claim or claims. Thus, nothing in the above description in any way limits the appended claims, unless and only to the extent expressly recited in a particular claim or claims.

Figure 3:
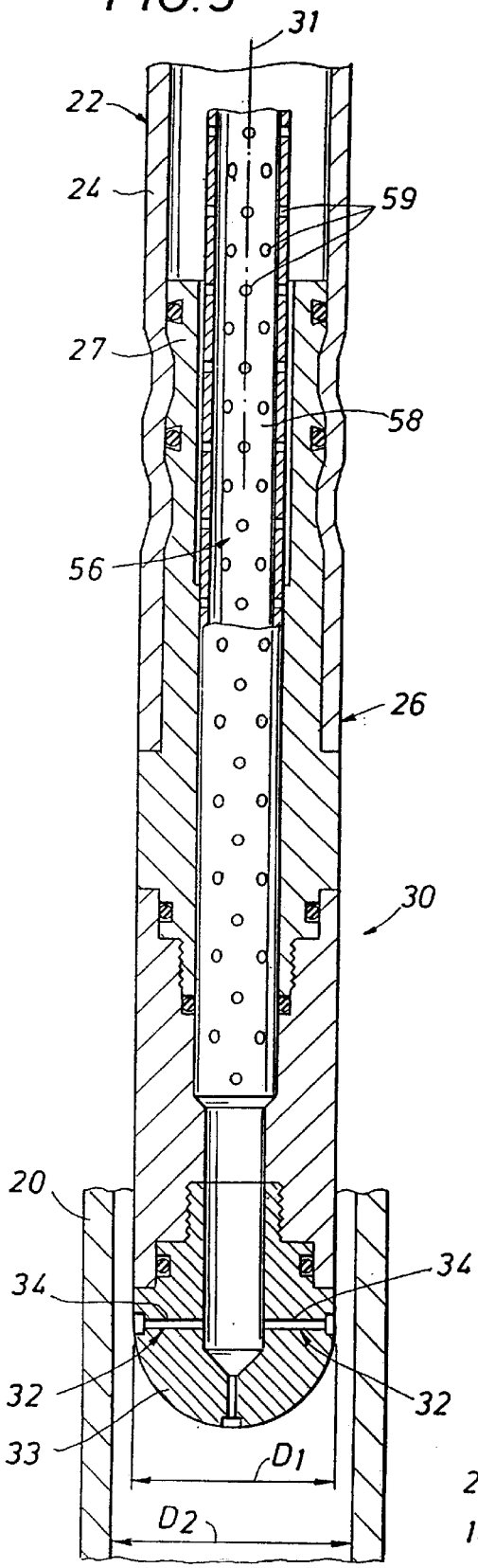
FIG. 3 is a partial cross-sectional view of another embodiment of a nozzle in accordance with the present invention.

Now referring to the present invention, in the embodiment of FIGS. 2 and 3, the nozzle assembly 30 is preferably disposed on the end 26 of the tubing 24, such as with a crimped, or rolled, connector 27. The nozzle assembly 30 includes one or more nozzle jets 32 capable of allowing ejection of the mixture 28 at a sufficient velocity and angle against obstructive material 14 built-up on the surface 18 to bombard, pulverize, fracture, erode or otherwise loosen the obstructions 14 from the surface 18. Any desirable quantity, size, orientation and configuration of nozzle jets 32 capable of removing obstructions 14 may be used.

In one embodiment, such as shown in FIGS. 5 and 5*a*, the nozzle jets 32 are formed integrally into a nozzle head member 33. In another embodiment, such as shown in FIGS. 6–6*b*, the nozzle jets 32 include fabricated or commercially available jet inserts 32*a* matable with threaded recesses 32*b* in nozzle head 33. The jet inserts 32*a* may be case hardened and may be overlaid with strengthening material, such as tungsten carbide, by methods known in the art, to prevent washing out. Should a nozzle jet insert 32*a* wash or fall out of an otherwise functional nozzle head 33, the nozzle head 33 may be reused by replacing the nozzle insert 32*a*. The nozzle head 33 may be constructed from various types of suitable materials, such as, for example, case-hardened commercial heat-treated steel. Material hardness of the nozzle head 33 can be increased with conventional strengthening treatments that are or become known in the art.

Figure 4:
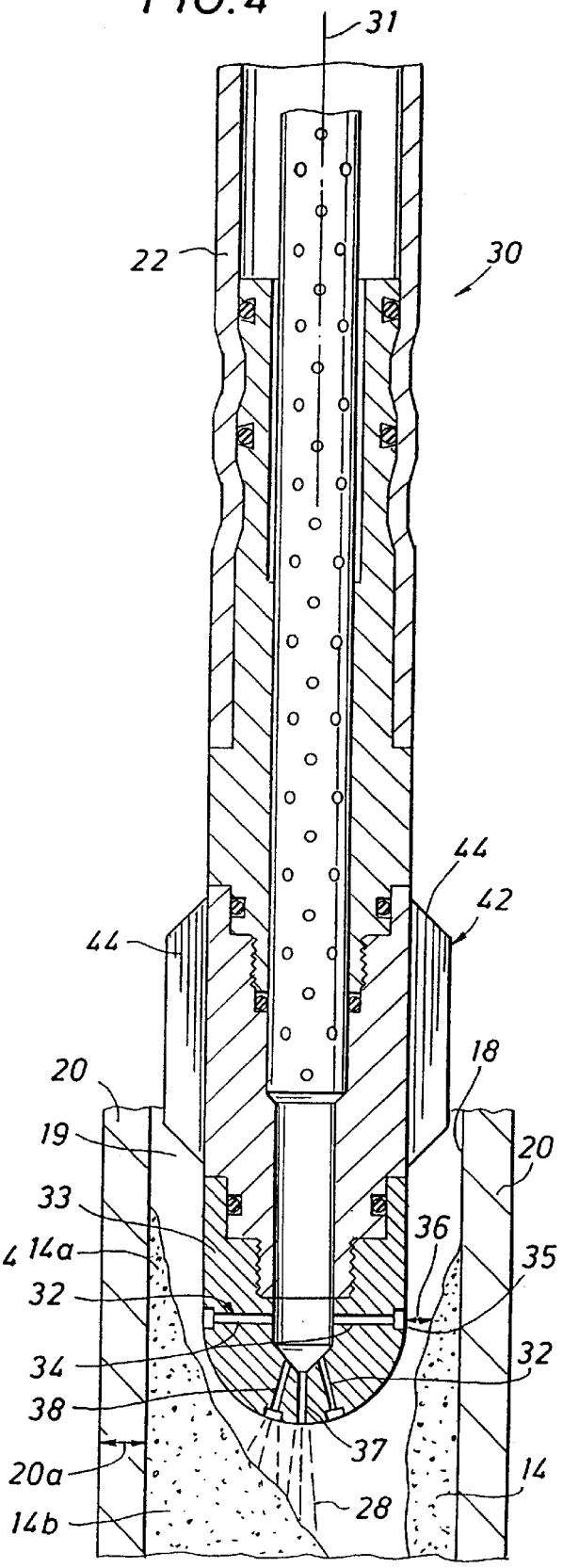
FIG. 4 is a partial cross-sectional view of yet another embodiment of a nozzle in accordance with the present invention in use in a conduit.

Referring to FIGS. 2 and 4, the jets 32 may be arranged in the nozzle assembly 30 in any configuration suitable for effective use with the present invention. In the preferred embodiments, the assembly 30 includes numerous jets 32 capable of ejecting mixture 28 at angles of about 80–100 degrees, preferably about 90 degrees, relative to obstructions 14. Depending on various factors, such as the type and velocity of the spherical solid particles in the mixture 28 and the hardness of the conduit surface 18, this approximate 90 degree jet orientation is capable of providing various benefits. For example, damage to the surface 18 of the conduit 20 may be minimized due to the shot-peening effect of certain types of spherical solid particles in the mixture 28 as they impact the surface 18. As obstructions 14 at a particular location on the metal surface 18 are pulverized and removed, certain types of spherical solid particles (in the mixture 28), such as, for example, glass spheres, produce tiny, shallow craters in the surface 18. Subsequently ejected spherical solid particles contacting the same location on the surface 18 will strike the crater peaks, reducing their height and smoothing the surface 18, providing a generally cold worked, uniformly compressed, work hardened metal layer. As a result, the thickness 20*a* of the conduit 20 is not significantly diminished. Further, in this example, no significant erosion is caused to the surface 18, which, after use of the system 10, may be more resistant to surface stress cracking than previously. It should be understood that this example of a benefit of the approximate 90 degree jet orientation is not necessary for practice of the present invention, and there are other benefits.

The distance 36 (FIG. 4) from the orifice 35 of a nozzle jet 32 to adjacent obstructions 14 is referred to herein as the "standoff" distance. It is generally desirable to have a minimal standoff distance 36 for various reasons, such as to enable the spherical solids in the mixture 28 to contact obstructions 14 at a maximum velocity and, hence, a maximum momentum, and to optimize system energy use. In contrast, a longer standoff distance 36 of mixture 28 from jets 32 to obstructions 14 will result in decreased velocity and momentum at the obstruction 14 and require more input energy for effective cleaning because the mixture 28 decelerates upon being ejected from the nozzle assembly 30. Further, the mixture 28 is slowed by the viscous forces of fluid it must pass through in the annulus 19 between the nozzle assembly 30 and the conduit 20. In addition, the spherical solids in the mixture 28 are subject to velocity loss due to eddy formation once ejected from the nozzle assembly 30.

Effective standoff distances 36 vary depending on numerous factors, such as the composition and velocity of the mixture 28 and the diameter and quantity of nozzle jets 32. For example, the delivery of a mixture 28 carrying spherical solid glass beads sized between about 60 mesh and about 100 mesh with a density of about 160 lb/ft$^3$ and having an ejection velocity of between about 300 ft/sec to about 700 ft/sec at the orifices 35 of between five and eight jets 32 of nozzle assembly 30 is capable of removing obstructions 14 of barium sulfate scale at a standoff distance 36 of at least about 0.15 inches. It should be understood that the present invention is not limited to the examples and values above (or any of the various other examples and values described elsewhere herein), all of which are provided for illustrative purposes.

Still referring to FIGS. 2 and 4, the preferred embodiments of the present invention include numerous jets 32 that are side nozzle jets 34 disposed in the nozzle assembly 30 at angles of between approximately 80 degrees and approximately 100 degrees (preferably about 90 degrees) relative to the central axis 31 of the nozzle assembly 30. The side jets 34 are preferably capable of ejecting mixture 28 generally at angles of about 90 degrees relative to obstructions 14*a* located adjacent to the nozzle assembly 30 and jets 34. The standoff distance 36 from the jet orifices 35 of nozzle jets 34 to the adjacent obstructions 14*a* may thus be minimized.

Referring to FIGS. 2, 4, 5 and 5*a*, additional jets 32, such as jets 37 and 38, may be included in the nozzle assembly 30 to provide the capability of at least partially clearing obstructions 14*b* built-up on the conduit surface 18 forward of the nozzle assembly 30, as well as loose or packed obstruction material or debris, such as sand, silt and other detritus, (not shown) located in the conduit 20 forward of the nozzle assembly 30. These jets 37, 38, when included, may assist in clearing a path forward of the nozzle assembly 30 to allow movement of the assembly 30 in the conduit 20 and positioning of the side jets 34 adjacent to the obstructions 14. For example, a center jet 37 disposed in the approximate, or exact, center of the front of the nozzle assembly 30 is capable of ejecting mixture 28 generally at an angle of about 0° relative to the central axis 31 of the nozzle assembly 30.

Mixture 28 ejected from jet 37 (FIG. 4) will contact obstructions 14*b* and other material located forward of the nozzle assembly 30. One or more angled jets 38 disposed around the center jet 37 can be oriented to eject mixture 28 at angles between about 0° and about 90°, such as about 15°, relative to the nozzle central axis 31, for impacting obstructions 14*b* located angularly forward of the nozzle assembly 30. Thus, one or more jets 32 may be positioned in different locations on the nozzle assembly 30 to form one or more "planes of obstruction contact" for removal of obstructions 14 and other debris at different locations in the conduit 20. In FIGS. 5, 5*a*, for example, side jets 34 form a first (primary) plane of obstruction contact around the circumference of the nozzle head 33, center jet 37 provides a second plane of contact, and angled jets 38 create a third simultaneous plane of contact.

Referring to FIG. 3, the outer nozzle diameter D1 of the nozzle assembly 30 is dictated by various factors, such as, but not limited to, the inner diameter D2 of the conduit 20, the thickness of the obstructions therein (not shown) and the pumping capability of the system pumping equipment. It may also be desirable or effective to use several nozzle assemblies 30 successively to clean a particular conduit 20. For example, a nozzle assembly 30 having a small outer nozzle diameter D1, such as approximately equal to the outer diameter of the carrier tubing 24 (FIG. 3), may be used initially to open a "pilot passage" through the obstructions 14 in the conduit 20. Thereafter, one or more other nozzle assemblies 30, each having a successively larger outer nozzle diameter D1, may be used for removing the obstructions 14 from conduit 20.

Figure 7:
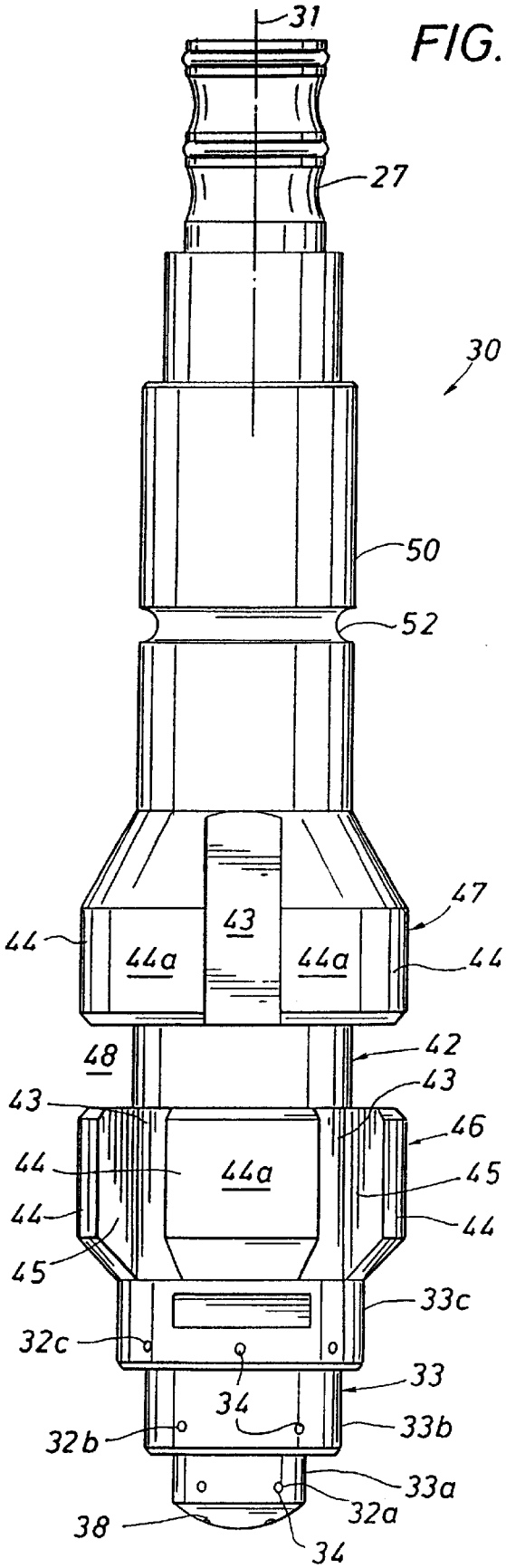
FIG. 7 is a side view of another embodiment of a nozzle assembly made in accordance with the present invention.

Furthermore, a single nozzle assembly 30 may be configured with nozzle jets 32 located at different nozzle diameters, such as, for example, in the embodiment shown in FIGS. 7 and 8. Nozzle head 33 has steps 33*a*, 33*b* and 33*c* of corresponding diameters d1, d2, and d3 and which carry jets 32*a*, 32*b* and 32*c*, respectively. The nozzle head 33 is shown also including angled jets 38. This assembly 30 may be useful to clear a pilot hole through the obstructions in the conduit (not shown) and also removing successive layers of obstructions (not shown). It should be understood, however, that the use of numerous nozzle assemblies 30 or a nozzle assembly 30 with jets 32 at different nozzle diameters is not necessary for the present invention.

Referring again to FIGS. 3 and 4, any suitable quantity of jets 32 can be used. The desired quantity of jets 32 can be determined based on various factors, such as but not limited to, the number of planes of obstruction contact on the assembly 30, the outer nozzle diameter D1, the conduit inner diameter D2, the composition of the mixture 28 and the thickness and composition of the obstructions 14. Nozzle assemblies 30 with large outer nozzle diameters D1 may require additional jets 32 to effectively remove obstructions 14 from the entire conduit surface 18. For example, a nozzle assembly 30 with an outer diameter D1 of between about 1.00 inches and about 1.25 inches and having five to six side jets 34 may be capable of sufficiently cleaning a conduit 20 having an inner conduit diameter D2 of between about 2.5 inches and 2.8 inches, while a nozzle assembly 30 having an outer diameter D1 of between about 2.0 inches and 2.5 inches and ten side jets 34 may be necessary for effectively cleaning a conduit 20 having an inner diameter D2 of between about 3.0 inches and about 3.5 inches. Another factor that may be desirable for consideration is that the greater the quantity of jets 32 contributing to a particular plane of obstruction contact, such as jets 34 of FIG. 3, the smaller the size of the removed particles of obstruction. For example, the configuration of nozzle 30 in FIG. 9, having four side jets 34 spaced evenly around the circumference of the nozzle head 33, will create larger sized removed particles of obstruction than the configuration of FIG. 10 having ten side jets 34 (for the same composition mixture 28 and type of obstruction 14).

The size and quantity of jets 32 in the nozzle assembly 30 may be selected to provide a particular ejection, or contact, velocity or velocity range of the mixture 28 at a given supply flow rate into the nozzle assembly 30. The velocity (V) of the mixture 28 at each jet orifice 35 equals the total flow rate ($Q_t$) of the mixture 28 through the jets 32 divided by the combined cross-sectional areas ($A_t$) of all jet orifices 35 ($V=Q_t/A_t$). Generally, the greater the quantity of jets 32 ejecting the mixture 28, the lower the ejection, or contact, velocity at the same supply flow rate into the carrier tubing 22. For example, a flow rate of about 0.75 bbl/min. of mixture 28 through a nozzle assembly 30 with seven jets 32 each having a diameter of about 0.063 inches may be capable of achieving ejection velocities of between about 500 ft/sec.

Now referring to FIGS. 4 and 11, the nozzle assembly 30 may be equipped with a gauge ring, or mandrel, 42 preferably located on the nozzle assembly 30 between the jets 32 and the carrier tubing 22. The gauge ring 42 may have any construction and configuration suitable for use with the present invention. Preferably, the gauge ring 42 includes at least one wide portion 44 that extends radially from the nozzle assembly 30 and one or more external fluid passageways 43 (FIG. 7). The "external" fluid passageways 43 are external to the nozzle assembly 30, allowing the flow of fluid along the outside of the nozzle assembly 30. The gauge ring 42 preferably has capabilities which include one or more of the following: generally guiding the carrier tubing 22 and nozzle assembly 30 through the conduit 20 ; centering the nozzle assembly 30 within the conduit 20 ; providing outer mandrel bearing surfaces 44*a* (FIG. 7) for bearing forces placed on the nozzle assembly 30 from contact with the conduit surface 18 (FIG. 2); detecting the presence and location of obstructions on the conduit surface 18 (FIG. 2); and allowing a fluid return flow path through the annulus 19 (FIG. 2) to the surface (not shown) for the ejected mixture 28 and removed obstructions.

The nozzle assembly 20 may be configured with two mandrels (not shown) or a mandrel 42 having numerous sets of wide portions 44, such as shown, for example, in FIGS. 7 and FIGS. 8, 8*a* and 8*b*. In the illustrated embodiment, a first set 46 of wide portions 44 is shown offset, such as by 45 degrees, relative to a second set 47 of wide portions 44. A space 48 is formed between the sets 46, 47 of wide portions 44. The gauge ring 42 is "fluted", the flutes 45 forming the fluid passageways 43. Adjacent flutes 45 of the same set of wide portions 46 or 47 are shown spaced apart 90 degrees from one another relative to the nozzle assembly central axis 31. This type of configuration is capable of providing 360 degrees of combined outer mandrel bearing surface 44*a* around the nozzle assembly 30, while allowing a "return flow path" through fluid passageways 43 and space 48.

The gauge ring 42 may be equipped with a fishing neck 50 capable of being connected with or gripped, such as at recess, or groove, 52 (FIGS. 7 and 8), by a conventional fishing tool (not shown) for recovery of the nozzle assembly 30 should the assembly 30 disconnect from the carrier tubing 22 in the conduit 20.

A filter 56, such as shown in FIGS. 2 and 3, may be included for various purposes, such as to regulate the size of the spherical solids in the mixture 28 being ejected from the nozzle assembly 30 and to prevent plugging of the jets 32. Any suitable filter 56 capable of use with the present invention may be used. In the embodiments of FIGS. 2 and 3, the filter 56 is disposed within the carrier tubing 22 and nozzle assembly 30. The illustrated filter 56 includes a perforated mesh 58 having a plurality of flow holes 59 of predetermined sizes, or diameters. To prevent plugging of the nozzle jets 32, the diameter of the flow holes 59 must be equal to or smaller than the diameter of the nozzle jets 32. The mixture 28 flows into the filter 56 from the tubing 22, such that spherical solids and any other solid materials in the mixture 28 or tubing 22 that are larger than the flow holes 59 will enter neither the filter 56 nor the nozzle assembly 30. Thus, undesirably large spherical solids or other material will remain in the tubing 22 outside of the filter 56, assisting in preventing both the filter 38 and nozzle assembly 30 from becoming clogged thereby. The inclusion of a filter 56, however, is not essential for the present invention.

The fluid or mixture 28 may be supplied, mixed and delivered to the nozzle of the present invention in any suitable manner, such as, for example, as described in U.S. patent app. Ser. No. 09/020,100 entitled Conduit Cleaning System and Method, filed on Feb. 6, 1998, now U.S. Pat. No. 6,170,577, which is incorporated by reference herein in its entirety.

An embodiment of a method for loosening and removing obstructions from inside a conduit 20 with the use of the exemplary nozzle 30 will now be described. The tubing 22 is insertable into the conduit 20 to position the nozzle assembly 30 at a desired location in the conduit 20 for obstruction removal. Preferably, the tubing 22 is controllably movable within the conduit 20 or within a desired portion or portions of the conduit 20 to allow the controlled removal of obstructions 14 therefrom. Any suitable conventional mechanism or technique may be used for moving the tubing 22 into, within and from the conduit 20. In the embodiment shown in FIG. 1, for example, an operator (not shown) controls the rate of injection and movement of the tubing 22 in the conduit 20 with the conventional truck-mounted coiled tubing control unit 64.

The mixture 28 pumped into the tubing 22 is ejected from the nozzle assembly 30 through the jets 32 at a velocity such that the force of the mixture upon the obstructions 14 will pulverize, fracture, erode or otherwise loosen the obstructions 14 from the conduit 20 preferably with minimal erosion or damage to the conduit surface 18. A gauge ring, or mandrel, 42, when included on the nozzle assembly 30, such as shown in FIG. 2, may be used to assist in locating obstructions 14, positioning the nozzle assembly 30 for obstruction removal, guiding the nozzle assembly 30 through the conduit 20, determining when obstructions 14 have been removed, and other possible functions as described above. Further, wide portions 44 of the mandrel 42 may be positioned on the nozzle assembly 30 substantially adjacent to certain jets 32, such as side jets 34, allowing timely positioning of such jets 32 adjacent to obstructions 14 encountered by the wide portions 44 for obstruction removal. Any other suitable method for loosening and removing obstructions may be used, and the present invention is in no way limited to the above-described exemplary method or the details described above.

The obstruction removal rate may be affected by a multitude of factors, including, but not limited to, the composite type, mass, size and concentration of the spherical solids in the mixture 28, the nozzle jet 32 configuration, and the frequency and intensity of impact by the spherical solids in the mixture 28 upon the obstructions 14. It should be understood, however, that the present invention is not limited to any particular combination, or combinations, of any such variables, but encompasses all combinations suitable for use with the present invention. For example, the obstruction removal rate generally increases as the mass of the spherical solids in the mixture 28 increases, under otherwise constant conditions. The mass of the spherical solids in the mixture 28 may be selectively increased, such as by increasing the concentration of the spherical solids in the mixture 28, or by increasing the particle size of the spherical solids, or a combination of both. Removed obstruction particle size may be important for various reasons, such as when targeting particular types of obstructions 14 for chemical reactivity where it may be desirable to have small sized removed particles, or to improve transport capabilities of removed obstruction particles.

The removed obstructions and ejected fluid or mixture may be disposed of in any suitable manner. For example, referring to FIGS. 1 and 2, as the obstructions 14 are removed from the conduit surface 18, the ejected mixture 28 and removed obstruction particles, referred to collectively herein as the "composite effluent 100" are preferably circulated, as shown with flow arrows 70 in FIG. 2, out of the conduit 20 through the annulus 19 formed between the tubing 22 and the conduit surface 18. The ejected mixture 28 alone, or with a suitable additional fluid, may serve as the return fluid for carrying, or forcing, the removed obstruction particles up the conduit 20 to the surface 12. It should be noted that the size of removed obstruction particles may affect their rate of evacuation. For example, large removed particles generally require a greater velocity and/or viscosity of the return fluid in the annulus 19 for moving the removed obstruction particles to the surface 12. However, the present invention and appended claims are not limited to the above method for loosening and removing obstructions from inside conduit 20, or by any of the above details, unless and only to the extent expressly recited in a particular claim or claims. Any suitable method of use of the present invention may be used. Thus, nothing in the above description in any way limits the appended claims, unless and only to the extent expressly recited in a particular claim or claims.

While preferred embodiments of this invention have been shown and described, modifications thereof can be made by one of ordinary skill in the art without departing from the spirit or teachings of this invention. The embodiments described and illustrated herein are exemplary only and are not limiting. Many variations and modifications of the apparatus and methods of the present invention are possible and are within the scope of the invention. Further, the apparatus and methods of the present invention offer advantages over the prior art that have not been addressed herein but are, or will become, apparent from the description herein. Accordingly, the scope of the invention is not limited to the embodiments described herein.

What is claimed is:

1. A nozzle assembly for ejecting a mixture that includes substantially spherically shaped solid abrasive particles and fluid, the nozzle assembly having a central axis and being associated with a mixture delivery tubing comprising:

a connector member connectable with the mixture delivery tubing, a nozzle head member having a plurality of nozzle jets, at least two of said nozzle jets disposed at angles of between approximately 80 degrees and approximately 100 degrees relative to the central axis of the nozzle assembly, and a gauge ring member disposed between said connector member and said nozzle head member.

2. The nozzle assembly of claim 1 further including a plurality of nozzle jet inserts matable with a plurality of recesses in said nozzle head member.

3. The nozzle assembly of claim 1 wherein at least one of said nozzle jets is disposed in the nozzle assembly at an angle of approximately 0 degrees relative to the central axis of the nozzle assembly.

4. The nozzle assembly of claim 3 wherein at least one of said nozzle jets is disposed in the nozzle assembly at an angle of between approximately 0 degrees and approximately 90 degrees relative to the central axis of the nozzle assembly.

5. The nozzle assembly of claim 3 wherein at least two of said nozzle jets are disposed in the nozzle assembly at angles of between approximately 10 degrees and approximately 20 degrees relative to the central axis of the nozzle assembly.

6. The nozzle assembly of claim 1 further comprising a plurality of nozzle assembly sections, each said nozzle assembly section having a diameter different than the diameter of adjacent said nozzle assembly sections and wherein at least one said nozzle jet is disposed in each said nozzle assembly section.

7. The nozzle assembly of claim 1 wherein said gauge ring includes at least one wide portion and at least one external fluid flow passageway, said at least one wide portion and said at least one external fluid flow passageway disposed between said nozzle jets and the mixture delivery tubing.

8. The nozzle assembly of claim 7 wherein said gauge ring includes a plurality of wide portions, each said wide portion having an outer bearing surface, said plurality of outer bearing surfaces extending around the circumference of the nozzle assembly.

9. The nozzle assembly of claim 7 wherein said at least one wide portion is proximate to at least two of said nozzle jets.

10. The nozzle assembly of claim 7 wherein said gauge ring includes first and second sets of wide portions, said second set of wide portions disposed between said first set of wide portions and said plurality of nozzle jets and being at least partially offset on the circumference of the nozzle assembly relative to said first set of wide portions.

11. The nozzle assembly of claim 1 wherein the nozzle assembly is disposed in a conduit, further comprising a fishing tool connection portion, wherein said fishing tool connection portion is capable of being engaged by a fishing tool latch mechanism.

12. The nozzle assembly of claim 11 wherein said fishing tool connection portion includes a recess capable of receiving a fishing tool latching mechanism.

13. The nozzle assembly of claim 1 further including a filter capable of preventing clogging of said nozzle jets from particles carried in the mixture.

14. The nozzle assembly of claim 13 wherein said filter is disposed at least partially in the mixture delivery tubing.

15. A fluid jetting apparatus capable of ejecting a mixture that includes substantially spherically shaped solid particles and fluid, the apparatus having a central axis and being connectable with a carrier, the apparatus comprising:

a nozzle head, at least one nozzle jet disposed in said nozzle head for ejecting a mixture that includes substantially spherically shaped solid particles and fluid, and at least one gauge portion disposed between said nozzle head and the carrier when the fluid jetting apparatus is connected with the carrier, said at least one gauge portion extending radially front the central axis of the fluid jetting apparatus farther than said nozzle head.

16. The apparatus of claim 15 wherein at least one said nozzle jet is disposed at an angle of between approximately 80 degrees and approximately 100 degrees relative to the central axis of the apparatus.

17. The apparatus of claim 16 wherein at least two said nozzle jets are disposed at angles of approximately 90 degrees relative to the central axis of the apparatus and at least two said nozzle jets are disposed at angles of approximately 15 degrees relative to the central axis of the apparatus.

18. The apparatus of claim 15 wherein at least first and second said nozzle jets are disposed at different radial distances from the central axis of the apparatus.

19. The apparatus of claim 15 wherein the fluid jetting apparatus is useful for loosening obstructive material adhered to the interior metallic surface of a conduit.

20. The apparatus of claim 19 wherein the standoff distance between at least one said nozzle jet and the interior metallic surface of the conduit is minimal.

21. The apparatus of claim 19 wherein at least one said gauge portion is capable of detecting obstructive material disposed on the interior surface of the conduit.

22. The apparatus of claim 21 wherein at least one said nozzle jet is positioned to discharge mixture against the interior surface of the conduit immediately below at least one said gauge portion.

23. The apparatus of claim 21 wherein at least one said gauge portion is capable of ensuring the existence of an axial passageway within the conduit that is at least substantially clear of obstructive material adhered to the interior metallic surface of the conduit.

24. The apparatus of claim 21 wherein the positioning of the at least one said gauge portion positions at least one said nozzle jet within the conduit to loosen obstructive material detected by the at least one said gauge portion.

25. The apparatus of claim 24 wherein the apparatus is axially moveable within the conduit in forward and rearward directions, whereby when at least one said gauge portion detects obstructive material disposed upon the interior surface of the conduit while the apparatus is moving forward within the conduit, said at least one gauge portion is capable of preventing further forward axial movement of the apparatus until at least part of the detected obstructive material is removed from the interior surface of the conduit.

26. The apparatus of claim 19 wherein at least one said gauge portion has at least one opening to allow fluid to pass through said at least one gauge portion.

27. The apparatus of claim 26 wherein the conduit is an underground oil field tubular.

28. The apparatus of claim 26 wherein the conduit is a fluid pipeline.

29. The apparatus of claim 19 wherein the fluid jetting apparatus is capable of ejecting the mixture to loosen obstructive material from the interior surface of the conduit without substantially damaging the conduit.

30. The apparatus of claim 29 wherein the apparatus is capable of removing obstructive material around the entire circumference of the conduit without rotating the nozzle head.

31. A nozzle useful for loosening obstructive material from the interior surface of a conduit, the nozzle having a central axis and comprising:

a nozzle head, at least one jetting orifice in said nozzle head, at least one of said at least one jetting orifice for ejecting a mixture that includes substantially spherically shaped solid particles and fluid, and at least one wide section capable of positioning at least one said jetting orifice within the conduit to loosen obstructive material disposed upon the interior surface of the conduit.

32. The nozzle of claim 31 further including at least one opening to allow fluid to pass by the nozzle.

33. The nozzle of claim 32 wherein at least one said wide section extends radially from the central axis of the nozzle farther than said nozzle head, and wherein at least one said jetting orifice is positioned to discharge the mixture against the interior surface of the conduit immediately below at least one said wide section.

34. The nozzle of claim 32 wherein the conduit is a fluid flowline.

35. The nozzle of claim 31 wherein the conduit is an underground oilfield tubular, and wherein the nozzle is deployed on coiled tubing and ejects a mixture including substantially spherically shaped solid particles to loosen obstructive material from the interior surface of the conduit without substantially damaging the interior surface.

36. The nozzle of claim 35 wherein at least one said jetting orifice discharges mixture at an optimal angle for fracturing obstructive material disposed upon the interior surface of the conduit.

37. A fluid jetting apparatus useful for removing obstructive material from the interior surface of a conduit, the apparatus having a central axis and comprising:

a nozzle head, at least one jetting orifice in said nozzle head for ejecting a mixture that includes substantially spherically shaped solid particles and fluid, and at least one wide section capable of detecting obstructive material disposed upon the interior surface of the conduit and ensuring the clearance of an axial passageway within the conduit that is at least substantially absent obstructive material adhered to the interior surface of the conduit.

38. The apparatus of claim 37 wherein the diameter of the axial passageway is approximately equal to the largest outer diameter of at least one said wide section.

39. The apparatus of claim 38 wherein the apparatus is capable of ejecting a mixture including substantially spherically shaped solid particles to loosen obstructive material from the interior surface of the conduit.

40. The apparatus of claim 39 further including between approximately four and approximately eight said jetting orifices disposed at angles of approximately 90 degrees relative to the central axis of the apparatus.

41. The apparatus of claim 39 wherein the apparatus is capable of ejecting a mixture including substantially spherically shaped solid particles to loosen obstructive material from the interior surface of the conduit without substantially damaging the interior surface of the conduit.

42. A fluid jetting nozzle useful in an oilfield tubular having an interior metallic surface, the fluid jetting nozzle comprising:

a nozzle heads and at least one jetting orifice in said nozzle head, said at least one jetting orifice for ejecting a mixture that includes substantially spherically shaped solid particles to loosen obstructive material from the interior metallic surface.

43. The fluid jetting nozzle of claim 42 wherein said at least one jetting orifice ejects the mixture to loosen obstructive material from the metallic surface without substantially damaging the metallic surface.

44. The fluid jetting nozzle of claim 43 wherein the metallic surface is the interior surface of a conduit.

45. The fluid jetting nozzle of claim 44 wherein the fluid jetting nozzle has a central axis, and wherein at least three said jetting orifices are disposed in said nozzle head at angles of between approximately 80 degrees and approximately 100 degrees relative to the central axis of the fluid jetting nozzle.

46. The fluid jetting nozzle of claim 44 wherein the fluid jetting nozzle has a central axis and further including between approximately four and approximately eight said jetting orifices disposed in said nozzle head at angles of approximately 90 degrees relative to the central axis of the fluid jetting nozzle.

47. The fluid jetting nozzle of claim 44 further including at least one gauge portion having a plurality of wide portions and a plurality of fluid passageways, each said fluid passageway being offset from at least one other said fluid passageway, and each said fluid passageway being in fluid communication with at least one other said fluid passageway.

48. The fluid jetting nozzle of claim 44 wherein at least one said gauge portion includes at least first and second sets of wide portions, each said wide portion having an outer bearing surface, said plurality of outer bearing surfaces extending around the circumference of the fluid jetting nozzle, and wherein said first set of wide portions is offset relative to said second set of wide portions.

49. The fluid jetting nozzle of claim 44 further including at least one gauge portion that detects obstructive material disposed upon the interior surface of the conduit.

50. The fluid jetting nozzle of claim 43 wherein said nozzle head includes a plurality of jetting orifice inserts matable with a plurality of recesses.

51. The fluid jetting nozzle of claim 42 further including a plurality of adjacent nozzle sections, the diameter of each said nozzle section differing from the diameter of at least one adjacent said nozzle section, and wherein at least one said jetting orifice is disposed in each said nozzle section.

52. A nozzle for removing obstructive material from a metallic surface in an oilfield tubular without substantially damaging the metallic surface, the nozzle having a central axis and comprising:

a nozzle head, and a plurality of nozzle jets, at least two said nozzle jets disposed at angles of approximately 90 degrees relative to the central axis of the nozzle for ejecting a mixture that includes substantially spherically shaped solid particles and fluid.

53. The nozzle of claim 52 wherein the nozzle ejects a mixture including substantially spherical solids to remove obstructive material from the metallic surface.

54. An apparatus useful for removing obstructive material from an interior metallic surface of a conduit with the use of a mixture including substantially spherically shaped solid particles, the conduit disposed at least partially underground, the apparatus having a central axis and being insertable into an opening in the conduit, the apparatus comprising:

means for ejecting the mixture against obstructive material adhered to the interior metallic surface of the conduit to loosen at least some of the obstructive material from the surface to allow passage of the apparatus thereby without substantially damaging the metallic surface, downhole means for positioning said means for ejecting the mixture, and means for allowing the flow of ejected mixture and removed obstructive material through the conduit to the conduit opening.

55. A method of cleaning an interior metallic surface of a conduit, the method comprising:

supplying a mixture that includes substantially spherically shaped solid particles to a jet cleaning apparatus, the apparatus having at least one jetting orifice, positioning at least one jetting orifice of the jet cleaning apparatus proximate to obstructive material adhered to the interior metallic surface, and ejecting the mixture from the jet cleaning apparatus through at least one jetting orifice against the obstructive material to loosen obstructive material from the surface without substantially damaging the surface.

56. The method of claim 55 wherein the jet cleaning apparatus includes at least one wide portion, the method further comprising including moving the jet cleaning apparatus through the conduit to allow the at least one wide portion to detect the presence and location of obstructive material adhered to the interior metallic surface.

* * * * *

UNITED STATES PATENT AND TRADEMARK OFFICE

CERTIFICATE OF CORRECTION

PATENT NO. : 6,325,305 B1 
DATED : December 4, 2001
INVENTOR(S) : Larry G. Kuhlman, Jerry W. Noles, Jr. and Dale Skinner It is certified that error appears in the above-identified patent and that said Letters Patent is hereby corrected as shown below:

Column 1,
Line 6, after "1998", please insert -- , which is incorporated herein by reference --.
Line 10, after "1997", please insert -- , which is also incorporated by reference herein in its entirety --.

Column 14,
Line 1, please delete "front", and insert therefor -- from --.

Column 15,
Line 59, please delete "heads", and insert therefor -- head --.

Signed and Sealed this

Thirteenth Day of May, 2003

JAMES E. ROGAN
*Director of the United States Patent and Trademark Office*